United States Patent [19]

Babberl

[11] 4,215,840

[45] Aug. 5, 1980

[54] DISPLAY SYSTEM

[75] Inventor: Marion G. Babberl, San Mateo, Calif.

[73] Assignee: Rapid Mounting & Finishing Company, Chicago, Ill.

[21] Appl. No.: 949,769

[22] Filed: Oct. 10, 1978

[51] Int. Cl.[2] ..... A47F 7/00; A47F 5/00

[52] U.S. Cl. ..... 248/221.4; 248/214; 248/311.2

[58] Field of Search ..... 248/220.2, 220.3, 221.3, 248/221.4, 222.1, 222.2, 222.3, 223.3, 223.4, 224.4, 225.1, 214, 311.1, 201; 211/94; 24/201 C, 243 K, 73 PF; 40/11 R

[56] References Cited

U.S. PATENT DOCUMENTS

| | | | |
|---|---|---|---|
| 459,844 | 9/1891 | Thomas | 248/222.2 X |
| 1,781,991 | 11/1930 | Stover | 211/94 UX |
| 1,800,387 | 4/1931 | Greist | 211/94 UX |
| 3,189,187 | 6/1965 | Guyer et al. | 248/311.1 X |
| 3,297,290 | 1/1967 | Patterson | 248/221.4 |
| 3,757,479 | 9/1973 | Martinez | 24/243 K |
| 3,815,756 | 6/1974 | Cox | 248/221.4 X |
| 3,831,892 | 8/1974 | Herman | 248/201 |
| 3,975,847 | 8/1976 | Slavsky | 40/11 R |
| 3,982,306 | 9/1976 | Curry | 24/243 K |
| 4,073,458 | 2/1978 | Sease | 248/340 |

FOREIGN PATENT DOCUMENTS

| | | | |
|---|---|---|---|
| 632013 | 12/1961 | Canada | 248/311.1 |
| 1491904 | 11/1977 | United Kingdom | 248/214 |

*Primary Examiner*—J. Franklin Foss

*Attorney, Agent, or Firm*—Wegner, Stellman, McCord, Wiles & Wood

[57] ABSTRACT

A display system having a shelf rail defining a pair of vertically spaced parallel confronting channels with a display element removably mounted to the shelf rail by means of one or more mounting clips. Each clip is defined by a base wall having upper and lower edge portions received in the channels of the shelf rail and a support wall having a connecting portion projecting forwardly from the base wall of the clips and an upright portion defining with the base wall an upwardly opening channel for receiving an edge portion of the display element wall. The display element wall may be provided with an opening slightly larger than the cross section of the connecting portion of the clip so as to provide a secure removable mounting of the display element on the clip.

13 Claims, 4 Drawing Figures

FIG. 1
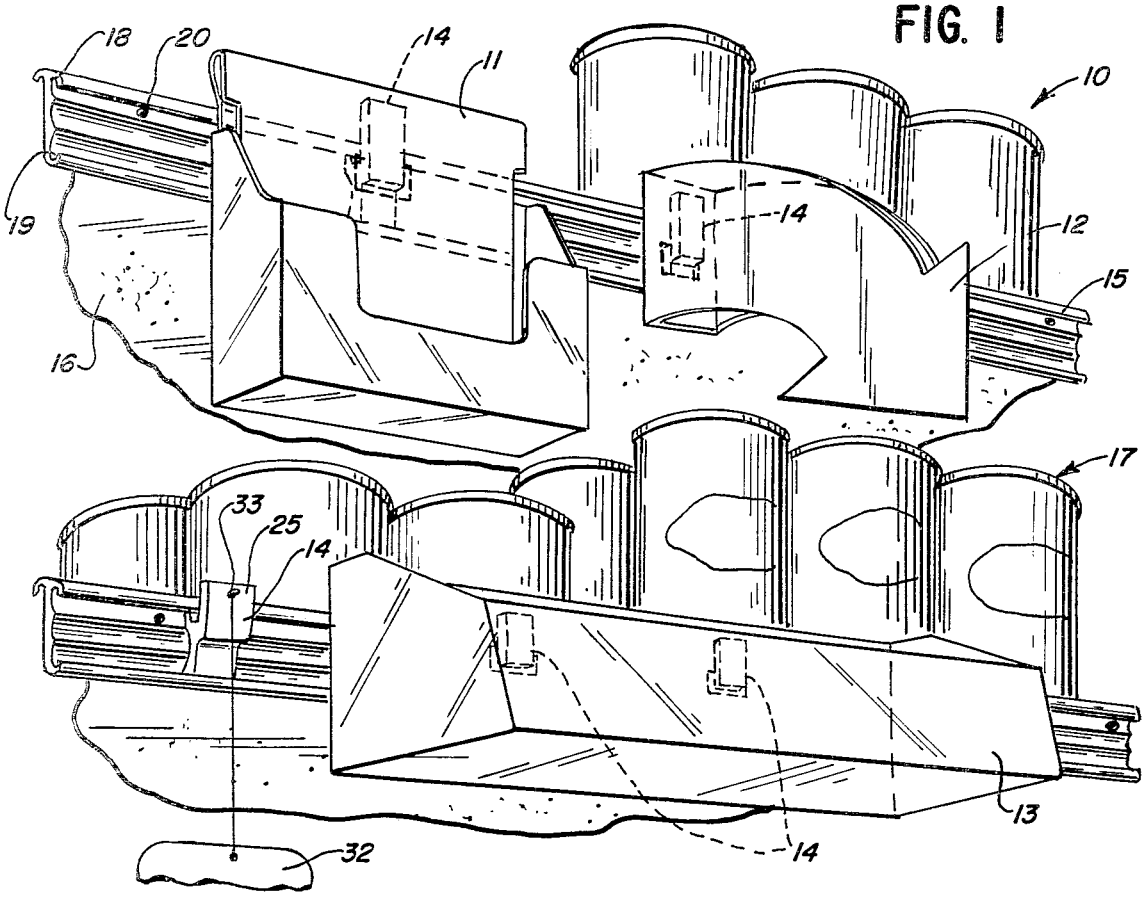
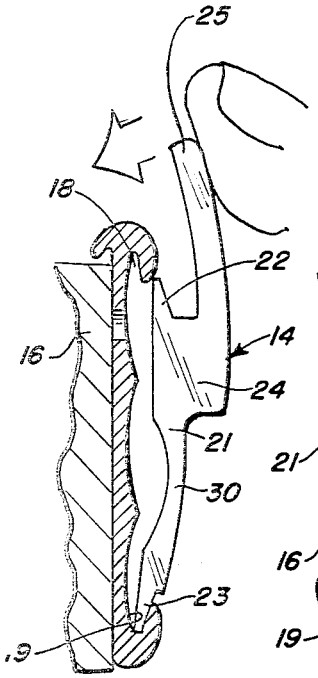
FIG. 2
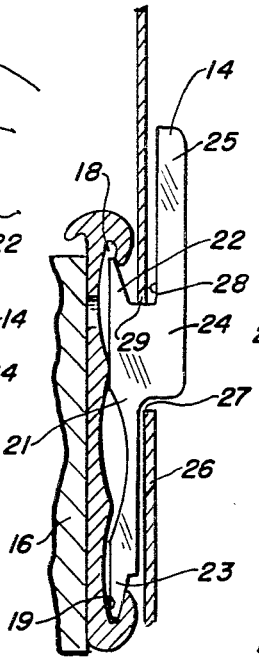
FIG. 3
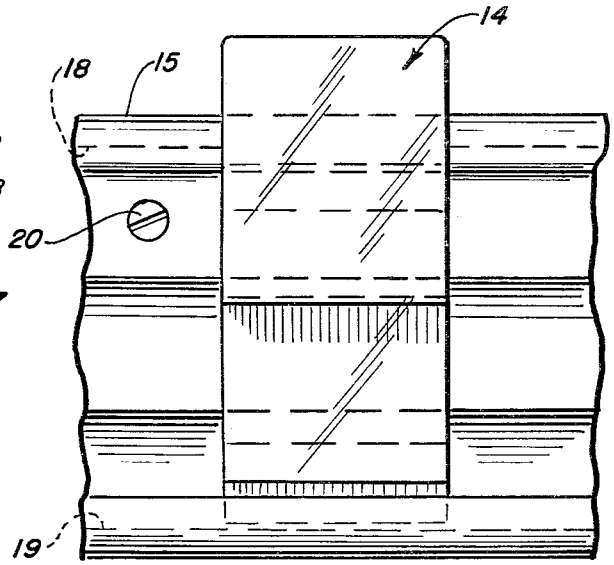
FIG. 4

DISPLAY SYSTEM

BACKGROUND OF THE INVENTION

1. Field of the Invention

This invention relates to display systems and in particular to means for removably mounting a display element to a shelf rail.

2. Description of the Prior Art

In grocery establishments and the like, it is conventional to provide a mounting rail on the front of the grocery shelves for receiving price cards and the like. Thus, the conventional shelf rail defines a lower, upwardly opening channel and an upper, downwardly opening channel for receiving the lower and upper edges of the flexible price cards respectively.

It is desirable to provide some means for installing displays other than simple price cards on the shelf rails, and the present invention is concerned with an improved display system wherein such means are provided.

A number of devices for use in mounting displays on the shelf or cabinets in such grocery establishments have been developed over the years. One such marker is shown in U.S. Pat. No. 2,923,078 of Robert J. Slavsky. As shown therein, the maker includes a springy wire portion compressibly received in the opposed channels of the shelf rail and having an outwardly projecting portion carrying a marker panel at its forward end.

Raymond T. Luck, in U.S. Pat. No. 2,925,239, shows a hook-type holder for hanging recipe books and similar articles in retail marketing operations. The holder is adapted for mounting in the conventional price card shelf rail and is defined by a sheet element having a struck hook portion.

In U.S. Pat. No. 3,056,572 of Lavern E. Gelow, a display easel is shown wherein a pair of base portions is provided at opposite sides of an elongated upright support portion. The base portions are adapted to be sprung into the channels of a conventional price card shelf rail.

Vincent Fortunato, in U.S. Pat. No. 3,288,414, shows a product support having a mounting wire portion adapted to be received in the opposed channels of the shelf rail and having a holder portion adapted to be received in a wall opening of an element to be carried thereby.

Lambert A. Lucietto et al show, in U.S. Pat. No. 3,429,539, an article supporting bracket wherein separate bracket parts are assembled and retained by suitable ratchet means to adjust the spacing of the lip portions received in the opposed channel flanges of the pricing channel.

Robert J. Slavsky, in U.S. Pat. No. 3,975,847, shows a one-piece card mounting clip adapted for mounting in a shelf rail having a pair of rearwardly projecting spring fingers receivable in the mounting rail channels, and a U-shaped card receiving portion.

SUMMARY OF THE INVENTION

The present invention comprehends an improved means for removably carrying a display element on the shelf rail.

In the illustrated embodiment, the mounting means comprises a unitary clip having a portion slidably and removably carried by the shelf rail and a portion removably carrying the display element.

More specifically, the invention comprehends the provision of such a clip defined by a base wall having a front face, an upper edge portion and a lower edge portion. The edge portions are arranged to be slidably received in the shelf rail channels, respectively.

The base wall is caused to be flexible to permit at least one of the edge portions to be deflected into its corresponding shelf rail channel.

In the illustrated embodiment, the base wall of the clip is provided with a reduced section portion providing additional flexibility for facilitated installation and removal of the clip relative to the shelf rail.

The edge portions of the clip may comprise wedge-shaped portions slidably received in the shelf rail channels.

The clip may be formed of a synthetic resin having relatively low friction so as to permit facilitated slidable adjustment of the clips on the shelf rail.

The means for mounting the display element to the clip may comprise a forwardly projecting connecting portion carrying at its forward end an upright portion.

The display elements may be provided with a rear wall having an opening adapted to pass the upright element so as to have the connecting portion received within the opening. The edge portion of the rear wall of the display element defining the upper edge of the opening may rest on the connecting portion within the upwardly opening channel of the clip in the assembled arrangement of the display system.

The opening in the rear wall of the display element may be slightly larger than the cross-sectional size of the connecting portion so as to provide a secure removable mounting of the display element on the mounting clip.

The display element may be provided with a number of openings in the rear wall thereof for cooperation with a corresponding plurality of mounting clips carried by the shelf rail in horizontaly spaced relationship to provide a stabilized mounting of display elements having substantial horizontal extent.

The display system of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary perspective view of a display system embodying the invention;

FIG. 2 is a fragmentary enlarged vertical section illustrating one step in the installation of the mounting clip to the shelf rail;

FIG. 3 is a vertical section illustrating the mounting of the clip to the shelf rail and with the rear wall of the display element mounted thereto; and FIG. 4 is a fragmentary front elevation of the mounting clip carried by the shelf rail.

DESCRIPTION OF THE PREFERRED EMBODIMENT

In the exemplary embodiment of the invention as disclosed in the drawing, a display system generally designated 10 is shown to include any one of a plurality of different display elements illustratively comprising display elements 11, 12 and 13, respectively. The display system utilizes an improved mounting clip generally designated 14 in removably mounting the display elements to a front rail 15 carried on a conventional shelf 16, such as a grocery store shelf adapted to carry a plurality of grocery items, such as canned food products 17.

Shelf radil 15 may comprise a conventional shelf rail defining a pair of vertically spaced, parallel confronting channels including upper, downwardly opening channel 18 and lower, upwardly opening channel 19. The shelf rail may be secured to the front edge of the shelf by suitable means, such as screws 20, to extend horizontally along the front face of the shelf.

The mounting clip 14 is adapted for mounting a wide range of different configuration display elements to the shelf rail, three exemplary display elements being illustrated in FIG. 1. As further illustrated in FIG. 1, the mounting clip 14 may be utilized singly in supporting the display elements, or a plurality of such mounting clips may be utilized for supporting the display elements such as where the display element has a relatively long horizontal extent, as exemplified by display element 13.

The mounting clip 14 is defined by a base wall 21 having an upper edge portion 22 and a lower edge portion 23. As shown in FIGS. 2 and 3, the edge portions may have a wedge-shaped configuration and are spaced apart on the base wall a preselected distance so as to be receivable in the upper and lower channels 18 and 19, respectively, of the shelf rail in the installed arrangement of the clip thereon.

The clip is preferably formed of an extruded synthetic resin having relatively low friction for facilitated slidable adjustment of the clip in the mounting rail. Further, the material of the clip is preferably somewhat flexible so as to permit facilitated installation and removal of the clip relative to the mounting rail, as illustrated in FIG. 2.

More specifically, the clip may be mounted to the shelf rail by firstly inserting the lower edge portion 23 into the lower channel 19 and then urging the upper edge portion 22 into the upper channel 18 by a rearward urging of the clip toward the shelf rail to permit the upper edge portion 22 to be deflected suitably to pass into the upper channel 18.

As shown in FIGS. 2 and 3, the mounting clip includes a connecting portion 24 projecting forwardly from the base wall 21 subjacent the upper edge 22 and provided at its front end with an upstanding portion 25 projecting upwardly from the connecting portion substantially above the upper edge 22. The upright portion is somewhat deflectible, as shown in FIG. 2, but is relatively thick so as to provide positive means for retaining the display device on the mounting clip in the installed arrangement, as shown in FIG. 3.

As further shown in FIG. 3, the rear wall 26 of the display element may be provided with a suitable opening 27 adapted to pass the upright wall 25 therethrough and receive the connecting portion 24 therein in the installed arrangement. The vertical height of the opening 27 is preferably only slightly greater than the vertical dimension of the connecting portion 24 so as to effectively retain the display device to the mounting clip in the installed arrangement, as shown in FIG. 3.

More specifically, the upright portion 25, connecting portion 24, and upper edge portion 22 of the mounting clip cooperatively define an upwardly opening channel 28 receiving the edge portion 29 of the display element rear wall defining the upper edge of the opening 27. Thus, the edge portion 29 rests on the connecting portion 24 in the assembled relationship shown in FIG. 3 to provide a positive support for the display device on the mounting clip. At the same time, the substantial vertical extent of the upright portion 25 effectively precludes undesirable separation of the display element from the mounting clip.

The opening 27 preferably has a horizontal extent substantially equal to the horizontal extent of the connecting portion 24 so as to provide a stabilized mounting of the display element on the mounting clip.

To provide for improved flexibility in the base wall, the base wall may include a portion 30 of reduced section cooperating with the flexibility of the edge portion 22 in permitting the facilitated installation and removal of the mounting clip relative to the shelf rail, as discussed above.

As shown in FIG. 1, the display devices may comprise upwardly opening boxes, as exemplified by display devices 11 and 13, or may comprise unique display configurations, such as the arrow configuration of device 12. Thus, the display devices are adapted for holding cards, or other literature associated with the grocery product 17, as desired. The relatively strong support to the display device provided by the mounting thereof to the clip connecting portion 24 and the retention thereof by the relatively rigid upright portion 25 permits a relatively substantial weight to be carried by the display device.

The mounting clips may be readily installed and removed relative to the shelf rail and, thus, provide substantial flexibility in the utilization of the display devices in connection with the grocery product 17.

As the connecting portion 24 is disposed closely subjacent the upper edge 22 of the mounting clip, the forces tending to urge the upper edge 22 forwardly from the channel 18 are effectively minimized, thus permitting relatively heavy display devices to be carried by the mounting clip, as discussed above.

As further shown in FIG. 1, the mounting clip may be utilized to hang a display device therefrom as by means of a suitable flexible element, such as cord 31, carrying at its lower end a suitable display element 32. The cord element may be secured to the front upright portion 25 by a suitable fastener 33 which may be extended through the mounting portion 25 as by suitably perforating the mounting portion.

Thus, as will be obvious to those skilled in the art, a wide variety of different elements may be supported in different manners from the mounting clips as the mounting clips provide a positive, firm support readily removably installed to the shelf rail.

Thus, the display system of the present invention is extremely simple and economical utilizing a low cost molded synthetic resin mounting means. The mounting clip means may be readily installed and removed as desired and does not interfere with the normal use of the shelf rail for carrying price cards and the like.

The foregoing disclosure of specific embodiments is illustrative of the broad inventive concepts comprehended by the invention.

I claim:

1. In a display system having a shelf rail defining upper and lower vertically spaced parallel confronting channels, the improvement comprising:

a unitary clip having a rigid connecting portion defining a rear portion and a front portion, a lower edge portion projecting downwardly from the rear portion of said connecting portion to be received in said shelf rail lower channel, an upper edge portion projecting upwardly from the rear portion of said connecting portion to be received in said shelf rail upper channel, the upper edge portion having a vertical extent substantially less than that of the lower edge portion, said lower edge portion including a reduced thickness flexible section permitting the edge portions to be deflected into the channel in mounting the clip to the shelf rail, and an upright portion projecting upwardly from the front portion of said connecting portion, defining with said upper edge portion an upwardly opening mounting channel; and a display element having a rear wall provided with an opening through which said connecting portion forwardly extends with an edge portion of the display element rear wall defining the upper edge of said opening received in said channel removably resting in said mounting channel.

2. In a display system having a shelf rail defining upper and lower vertically spaced parallel confronting channels, the improvement comprising:

a unitary clip having a rigid connecting portion defining a rear portion and a front portion, a lower edge portion projecting downwardly from the rear portion of said connecting portion to be received in said shelf rail lower channel, an upper edge portion projecting upwardly from the rear portion of said connecting portion to be received in said shelf rail upper channel, at least one of said edge portions being flexible to be deflected into the channel in mounting the clip to the shelf rail, and an upright portion projecting upwardly from the front portion of said connecting portion, defining with said upper edge portion an upwardly opening mounting channel; and a display element having a rear wall provided with an opening through which said connecting portion forwardly extends with an edge portion of the display element rear wall defining the upper edge of said opening received in said channel removably resting in said mounting channel, said lower edge portion of the clip comprising a wall having a section of reduced thickness subjacent said connecting portion for providing flexibility thereat.

3. In a display system having a shelf rail defining upper and lower vertically spaced parallel confronting channels, the improvement comprising:

a unitary clip having a rigid connecting portion defining a rear portion and a front portion, a lower edge portion projecting downwardly from the rear portion of said connecting portion to be received in said shelf rail lower channel, an upper edge portion projecting upwardly from the rear portion of said connecting portion to be received in said shelf rail upper channel, at least one of said edge portions being flexible to be deflected into the channel in mounting the clip to the shelf rail, and an upright portion projecting upwardly from the front portion of said connecting portion, defining with said upper edge portion an upwardly opening mounting channel; and a display element having a rear wall provided with an opening through which said connecting portion forwardly extends with an edge portion of the display element rear wall defining the upper edge of said opening received in said channel removably resting in said mounting channel, said edge portions of the clip defining wedge-shaped distal edges.

4. In a display system having a shelf rail defining upper and lower vertically spaced parallel confronting channels, the improvement comprising:

a unitary clip having a rigid connecting portion defining a rear portion and a front portion, a lower edge portion projecting downwardly from the rear portion of said connecting portion to be received in said shelf rail lower channel, an upper edge portion projecting upwardly from the rear portion of said connecting portion to be received in said shelf rail upper channel, at least one of said edge portions being flexible to be deflected into the channel in mounting the clip to the shelf rail, and an upright portion projecting upwardly from the front portion of said connecting portion, defining with said upper edge portion an upwardly opening mounting channel; and a display element having a rear wall provided with an opening through which said connecting portion forwardly extends with an edge portion of the display element rear wall defining the upper edge of said opening received in said channel removably resting in said mounting channel, said connecting portion of the clip being parallelepiped.

5. In a display system having a shelf rail defining upper and lower vertically spaced parallel confronting channels, the improvement comprising:

a unitary clip having a rigid connecting portion defining a rear portion and a front portion, a lower edge portion projecting downwardly from the rear portion of said connecting portion to be received in said shelf rail lower channel, an upper edge portion projecting upwardly from the rear portion of said connecting portion to be received in said shelf rail upper channel, at least one of said edge portions being flexible to be deflected into the channel in mounting the clip to the shelf rail, and an upright portion projecting upwardly from the front portion of said connecting portion, defining with said upper edge portion an upwardly opening mounting channel; and a display element having a rear wall provided with an opening through which said connecting portion forwardly extends with an edge portion of the display element rear wall defining the upper edge of said opening received in said channel removably resting in said mounting channel, said connecting portion of the clip comprising a substantially rigid block.

6. In a display system having a shelf rail defining upper and lower vertically spaced parallel confronting channels, the improvement comprising:

a unitary clip having a rigid connecting portion defining a rear portion and a front portion, a lower edge portion projecting downwardly from the rear portion of said connecting portion to be received in said shelf rail lower channel, an upper edge portion projecting upwardly from the rear portion of said connecting portion to be received in said shelf rail upper channel, at least one of said edge portions being flexible to be deflected into the channel in mounting the clip to the shelf rail, and an upright portion projecting upwardly from the front portion of said connecting portion, defining with said upper edge portion an upwardly opening mounting channel; and a display element having a rear wall provided with an opening through which said connecting portion forwardly extends with an edge portion of the display element rear wall defining the upper edge of said opening received in said channel removably resting in said mounting channel, said upright portion of the clip comprising a deflectible portion.

7. In a display system having a shelf rail defining upper and lower vertically spaced parallel confronting channels, the improvement comprising:

a unitary clip having a rigid connecting portion defining a rear portion and a front portion, a lower edge portion projecting downwardly from the rear portion of said connecting portion to be received in said shelf rail lower channel, an upper edge portion projecting upwardly from the rear portion of said connecting portion to be received in said shelf rail upper channel, at least one of said edge portions being flexible to be deflected into the channel in mounting the clip to the shelf rail, and an upright portion projecting upwardly from the front portion of said connection portion, defining with said upper edge portion an upwardly opening mounting channel; and a display element having a rear wall provided with an opening through which said connecting portion forwardly extends with an edge portion of the display element rear wall defining the upper edge of said opening received in said channel removably resting in said mounting channel, said upper edge portion of the clip defining a flexible distal edge.

8. The display system of claim 1 wherein said clip is formed of a synthetic resin having low friction for facilitated slidable positioning in said shelf rail channels.

9. The display system of claim 1 wherein said edge portions have a horizontal length substantially equal to the horizontal length of said upright portion.

10. The display system of claim 1 wherein said display element opening has a height slightly larger than the height of said connecting portion.

11. The display system of claim 1 wherein said display element rear wall has a second opening and a second said clip is slidably mounted to said shelf rail to extend through said second opening for supporting the display element at horizontally spaced locations of said rear wall.

12. In a display system having a shelf rail defining upper and lower vertically spaced parallel confronting channels, the improvement comprising:

a unitary clip having a rigid connecting portion defining a rear portion and a front portion, a lower edge portion projecting downwardly from the rear portion of said connecting portion to be received in said shelf rail lower channel, an upper edge portion projecting upwardly from the rear portion of said connecting portion to be received in said shelf rail upper channel, the upper edge portion having a vertical extent substantially less than that of the lower edge portion, said lower edge portion including a reduced thickness flexible section permitting the edge portions to be deflected into the channel in mounting the clip to the shelf rail, and an upright portion projecting upwardly from the front portion of said connecting portion, defining with said upper edge portion an upwardly opening mounting channels; and a removable fastener on the upper distal end of said upright portion for carrying a flexible hanger element.

13. The display system of claim 1 wherein said upright portion has a vertical extent substantially greater than that of said upper edge portion.

* * * * *